US006791037B1

(12) United States Patent
Ling

(10) Patent No.: US 6,791,037 B1
(45) Date of Patent: Sep. 14, 2004

(54) MULTI-DIRECTION SWITCH

(75) Inventor: Ying-Liang Ling, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/740,639

(22) Filed: Dec. 22, 2003

(51) Int. Cl.[7] ..... H01H 9/00

(52) U.S. Cl. ..... 200/4; 200/6 R; 200/5 R; 338/99; 345/157

(58) Field of Search ..... 200/6 R, 6 A, 200/5 R, 5 A, 4, 335, 17 R, 18, 1 B; 345/161, 157; 338/95, 99

(56) References Cited

U.S. PATENT DOCUMENTS 4,492,830 A * 1/1985 Kim ..... 200/6 A
4,778,952 A * 10/1988 Watkins et al. ..... 200/5 A
5,486,669 A * 1/1996 Oshgan ..... 200/556
5,889,242 A * 3/1999 Ishihara et al. ..... 200/6 A
6,160,225 A * 12/2000 Isikawa ..... 200/4
6,184,480 B1 * 2/2001 Nishimoto et al. ..... 200/4
6,586,690 B2 * 7/2003 Shimomura et al. ..... 200/6 A

* cited by examiner

*Primary Examiner*—Kyung Lee
(74) *Attorney, Agent, or Firm*—Birch, Stewart, Kolasch & Birch, LLP

(57) ABSTRACT

A multi-direction switch that is less likely to generate erroneous movement and may reduce fabrication and assembly difficulty includes redesigned metal conductive legs of a joystick and corresponding electrode elements so that the interval between the metal conductive legs and the electrode elements increases to prevent the metal conductive legs from mistakenly connecting the electrode elements when the joystick is depressed thereby to increase oscillation amplitude of the joystick and improve the operation maneuverability thereof.

5 Claims, 9 Drawing Sheets

MULTI-DIRECTION SWITCH

FIELD OF THE INVENTION

The present invention relates to a miniature switch and particularly to the structure of a multi-direction switch.

BACKGROUND OF THE INVENTION

Multi-direction switch is one of input devices adopted for use on small electronic devices such as personal digital assistant (PDA) or mobile communication devices. A conventional multi-direction switch provides input commands or instructions that include horizontal "direction instruction" (such as X and Y axes and right up, right down, left up and left down) and a single "button key instruction" (such as the instruction generated when the multi-direction switch is depressed). By means of this multi-direction switch, the cursor of a small electronic device may be controlled or operation of functional items may be executed.

Refer to FIGS. 1A, 1B and 1C for a conventional multi-direction switch. As shown in FIG. 1A, it has a base dock 10 which has first to fourth electrodes 101–104 located respectively at four corners. There is a central electrode 105 in the center surrounding by a common electrode 106 (generally a common ground electrode). The first to fourth electrodes 101–104 have respectively a leg 101*a*–104*a* exposed outside the periphery of the base dock 10 to connect a circuit (such as a circuit on a printed circuit board). The central electrode 105 and the common electrode 106 connect respectively to the circuit through legs 105*a* and 106*a* that also are exposed outside the base dock 10. The main operation element of the multi-direction switch is a joystick 11. It has four metal contact legs 110 extending horizontally from the periphery thereof. By moving the joystick 11, the four metal legs 110 may be respectively in contact with the first to fourth electrodes 101–104. The joystick 11 has a bottom end 111 in the center above two overlapped and elastic metal blades 121 and 122 in normal conditions. The metal blade 122 is located at the lower side to be in contact with the common electrode 106 in the normal conditions (also referring to FIG. 1C).

When the joystick 11 is depressed vertically, the two elastic metal blades 121 and 122 are deformed to enable the center point of the lower metal blade 122 in contact with the central electrode 105 so that the central electrode 105 and the common electrode 106 are connected and become conductive through the elastic metal blade 122 to generate a button key instruction. By the same token, when the joystick 11 is moved in the horizontal direction, the metal contact leg 110 in the corresponding direction will be moved to contact any one or more of the first to fourth electrodes 101–104 in the corresponding direction. Through the contact of the first to fourth electrodes 101–104 and the metal contact leg 110, the metal contact leg 110 and the elastic metal blades 121 and 122 that in contact with the bottom end 111 of the joystick 11 in normal conditions, and the common electrode 106 may form electric connection. And through signal triggering conditions of the first to fourth electrodes 101–104, a "directional instruction" of the joystick 11 may be determined.

The maximum compression displacement of the joystick 11 of such a multi-direction switch is limited by the deformation of the elastic metal blades 121 and 122 (about 0.15 mm). The oscillation amplitude of the joystick 11 at two sides of the axial direction is also restricted in a smaller range. As a result, it causes inconvenience during user operation. Moreover, as the metal contact leg 110 is extended horizontally, when the joystick 11 is moved, in order to ensure that the metal contact leg 110 to connect any one or more of the first to fourth electrodes 101–104, the locations of the first to fourth electrodes 101–104 have to be raised to an elevation close to the metal contact leg 110 (as shown in FIG. 1B). Such a design shrinks the vertical distance between the metal contact leg 110 and the first to fourth electrodes 101–104 and is prone to cause erroneous movement. For instance, when the joystick 11 is depressed, a small shaking of the joystick 11 could cause the metal contact leg 110 to mistakenly touch the first to fourth electrodes 101–104 and result in erroneous movement and generate a wrong directional instruction. And the small dimension and gap also make fabrication and assembly difficult.

SUMMARY OF THE INVENTION

Therefore the primary object of the present invention is to provide a multi-direction switch that is less likely to generate erroneous movements.

The present invention mainly has redesigned the metal contact legs of the joystick and the corresponding electrode elements to achieve the object mentioned above. The invention has lowered the location of the electrode elements and changed the shape of the metal contact legs to increase the interval of the metal contact legs and the electrode elements. Therefore it can prevent the metal contact legs from mistakenly connecting to the electrode elements when the joystick is depressed. The oscillation amplitude of the joystick during operation increases and operational maneuverability improves.

Furthermore, the design of the invention also reduces the difficulty of fabrication and assembly.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1A:
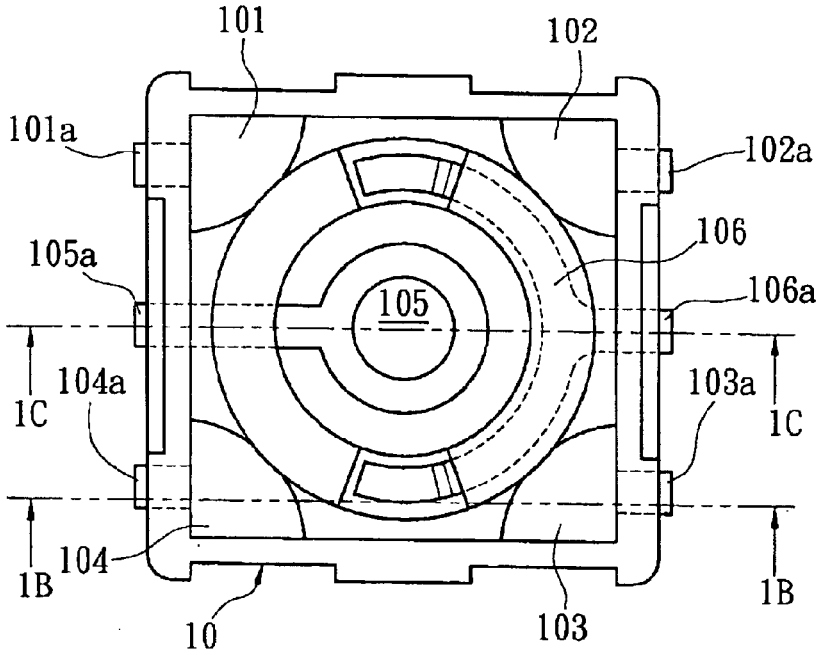
Fig. 1A PRIOR ART
FIG. 1A is a schematic view of the base dock structure of a conventional multi-direction switch.
Figure 1B:
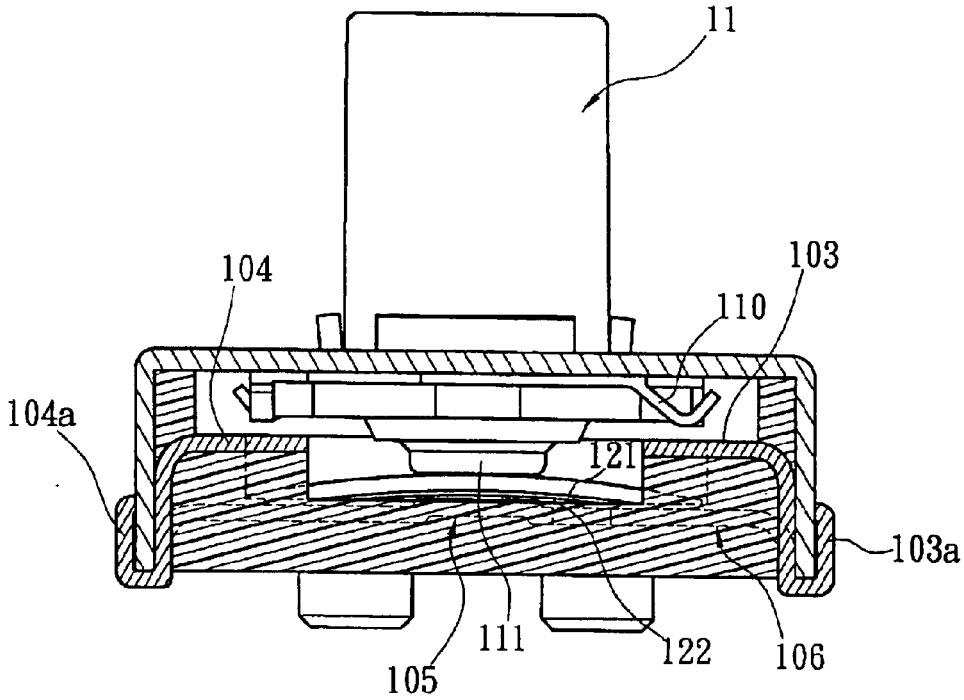
Fig. 1B PRIOR ART
FIG. 1B is a cross section of a conventional multi-direction switch taken on line 1B—1B in FIG. 1A.
Figure 1C:
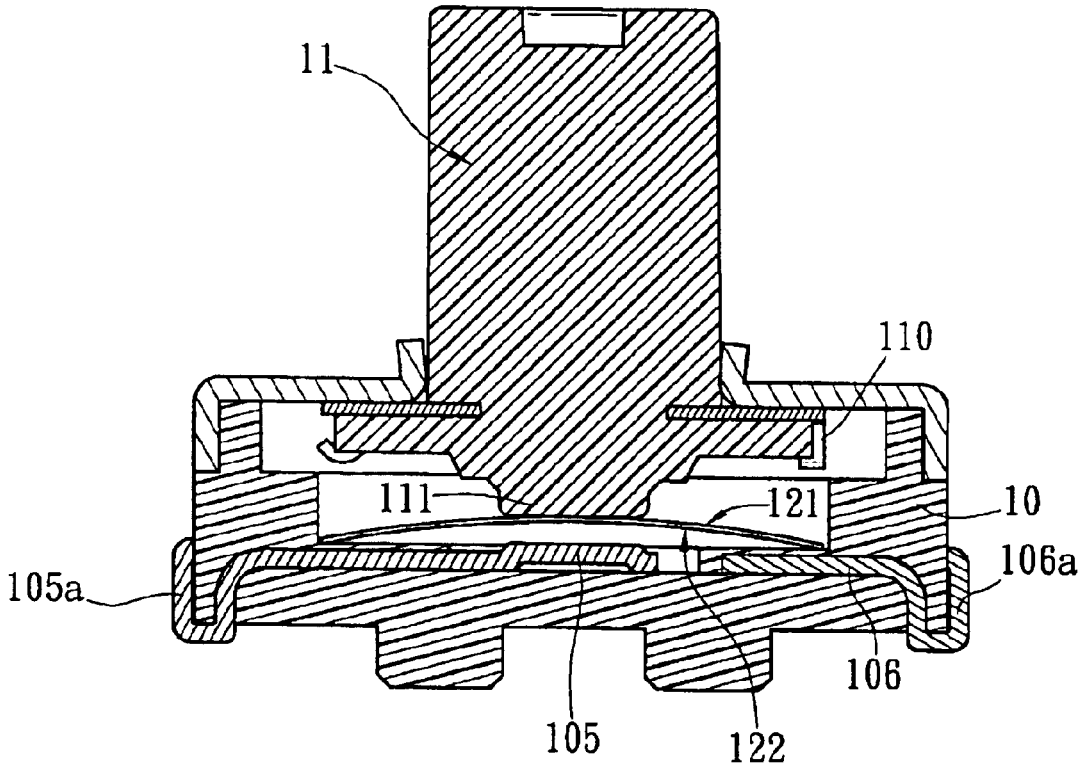
Fig. 1C PRIOR ART
FIG. 1C is a cross section of a conventional multi-direction switch taken on line 1C—1C in FIG. 1A.
Figure 2A:
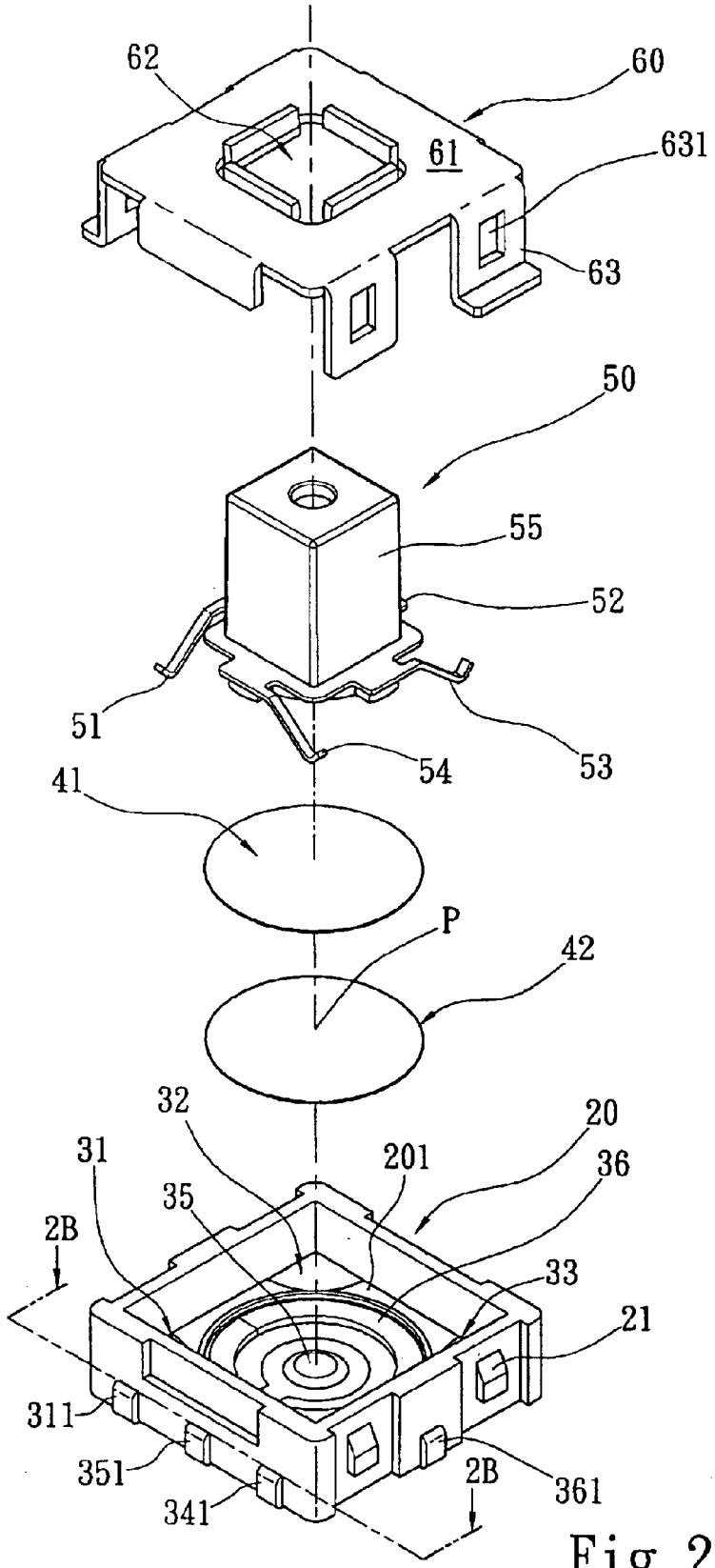
FIG. 2A is an exploded view of the multi-direction switch according to the invention.
Figure 2B:
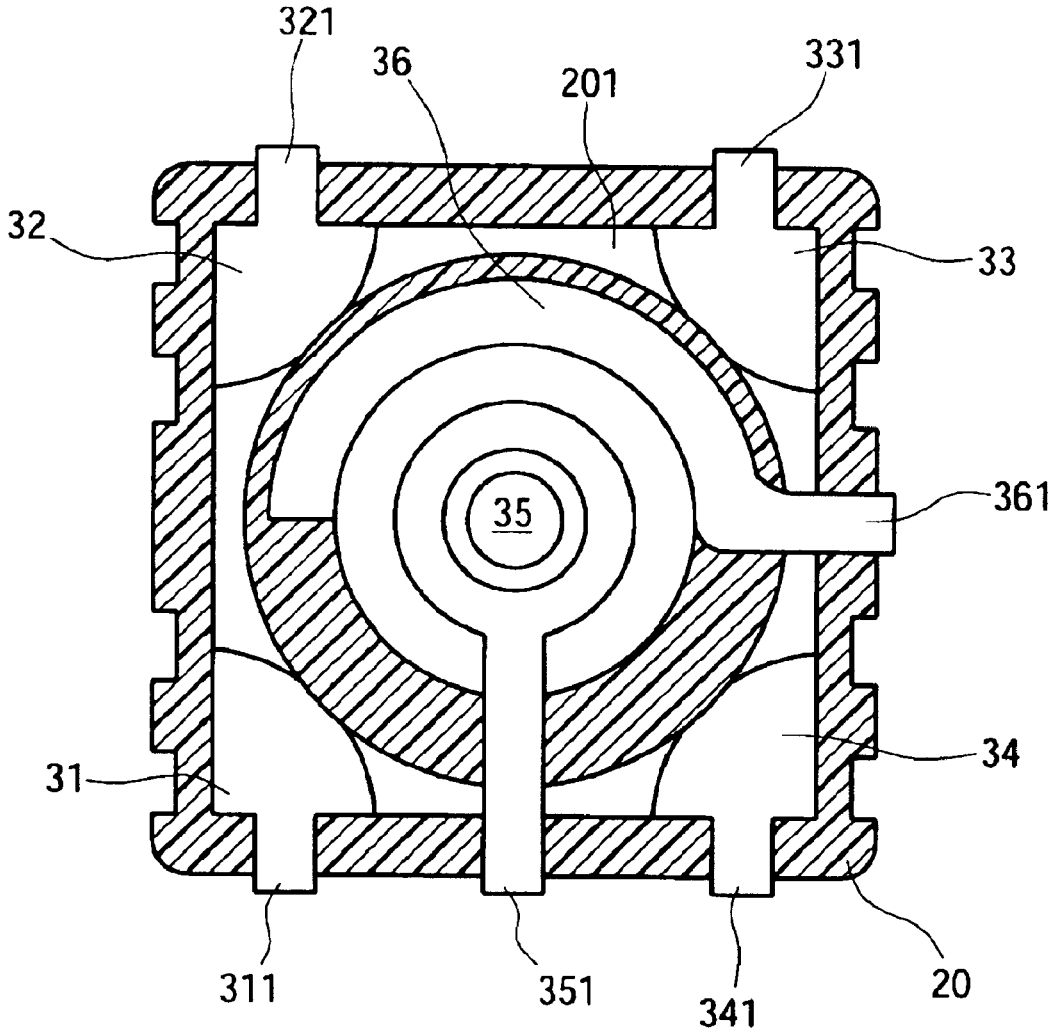
FIG. 2B is a cross section of taken on line 2B—2B in FIG. 2A.
Figure 3A:
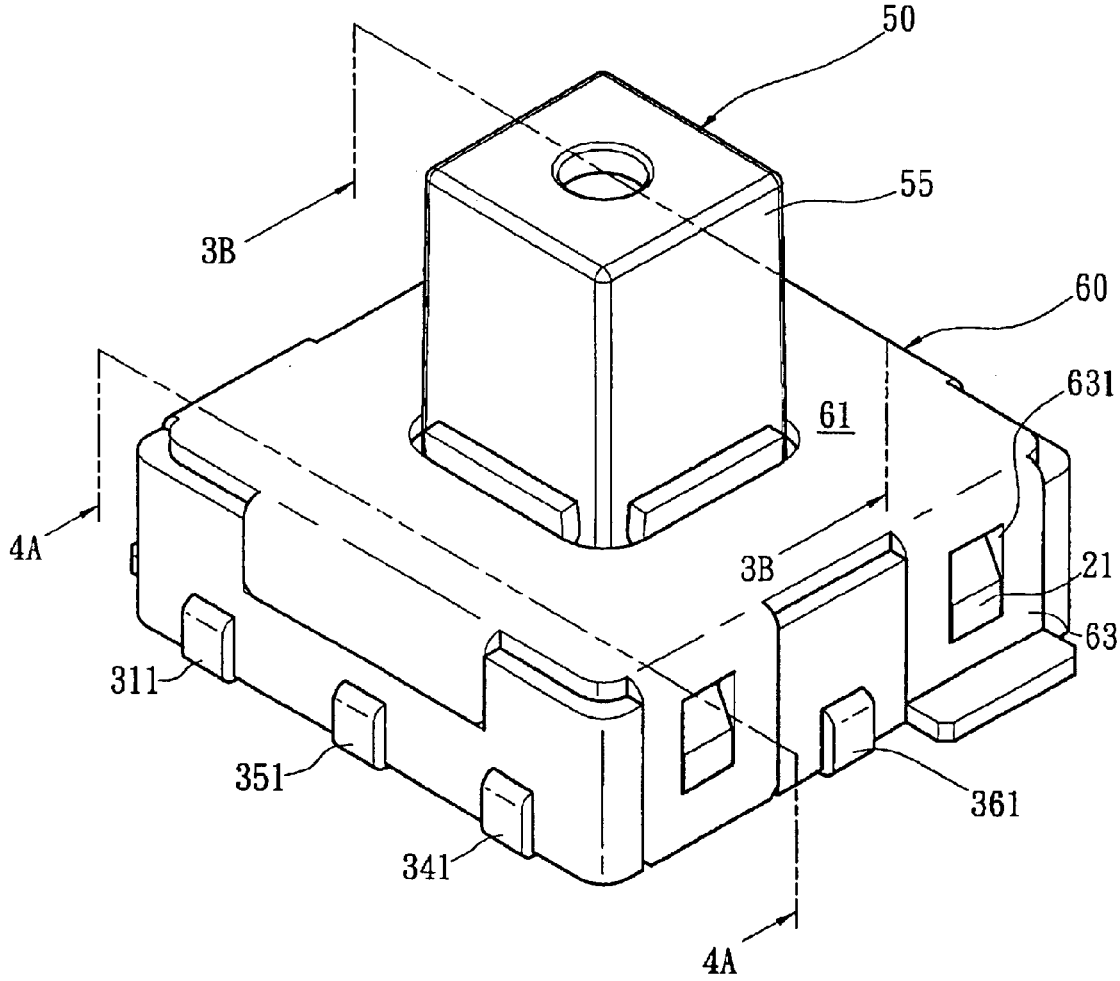
FIG. 3A is a perspective view of the multi-direction switch according to the invention.
Figure 3B:
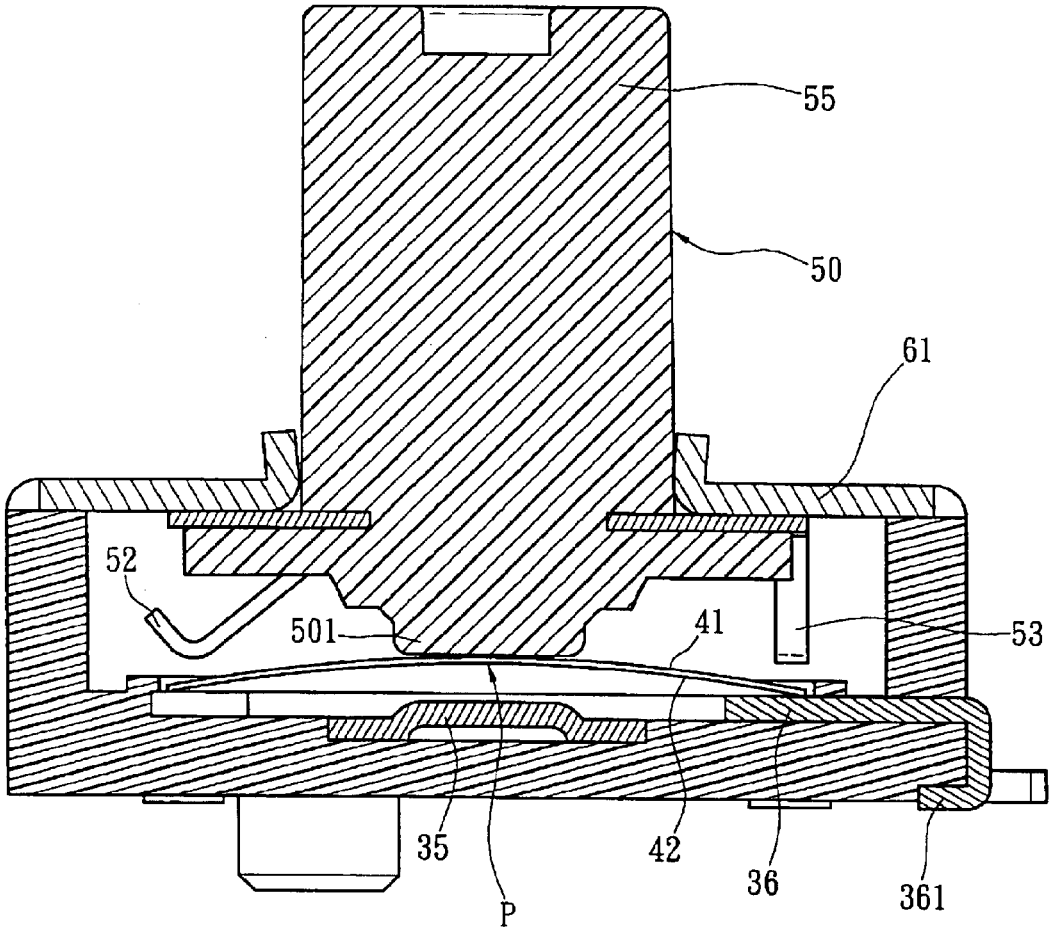
FIG. 3B is a cross section taken on line 3B—3B in FIG. 3A.
Figure 3C:
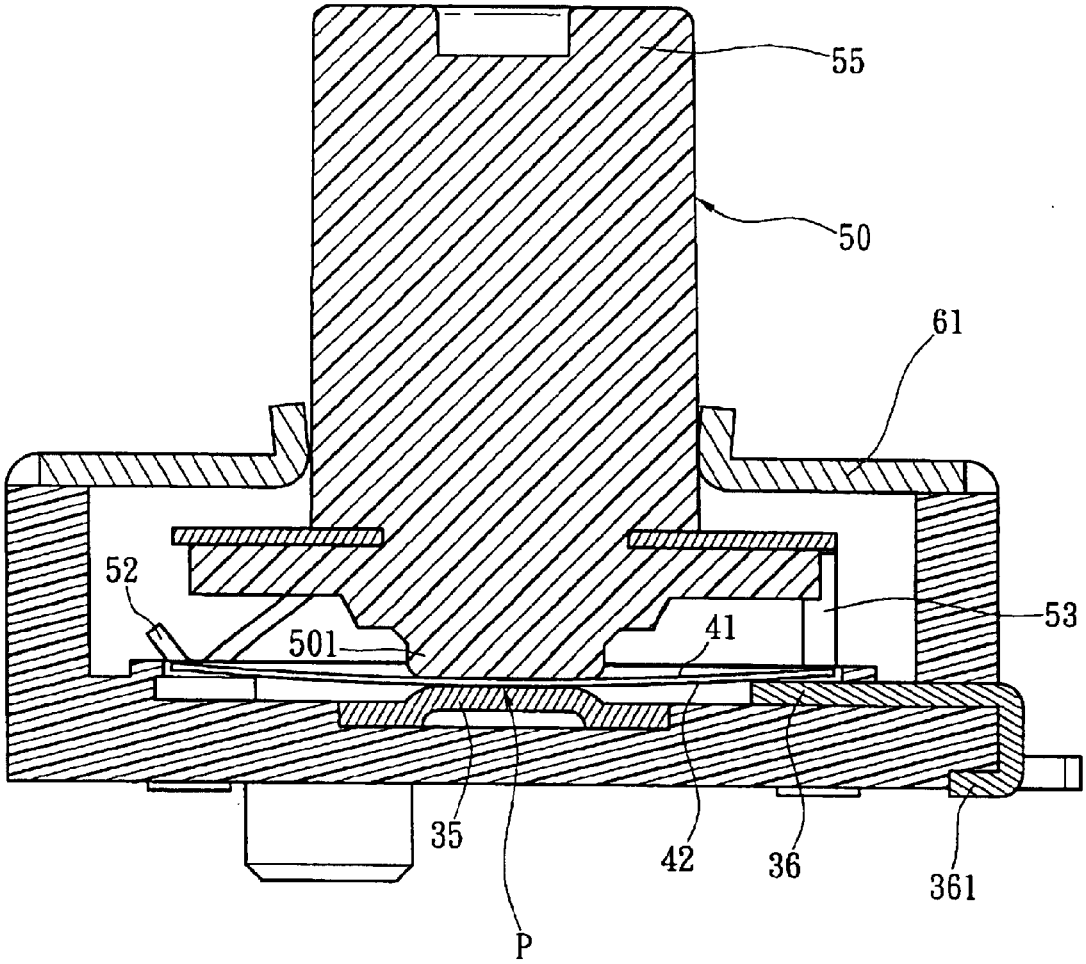
FIG. 3C is a schematic view of the operation condition according to FIG. 3B, showing a conductive contact leg connecting to a direction electrode when the joystick is oscillating.
Figure 4A:
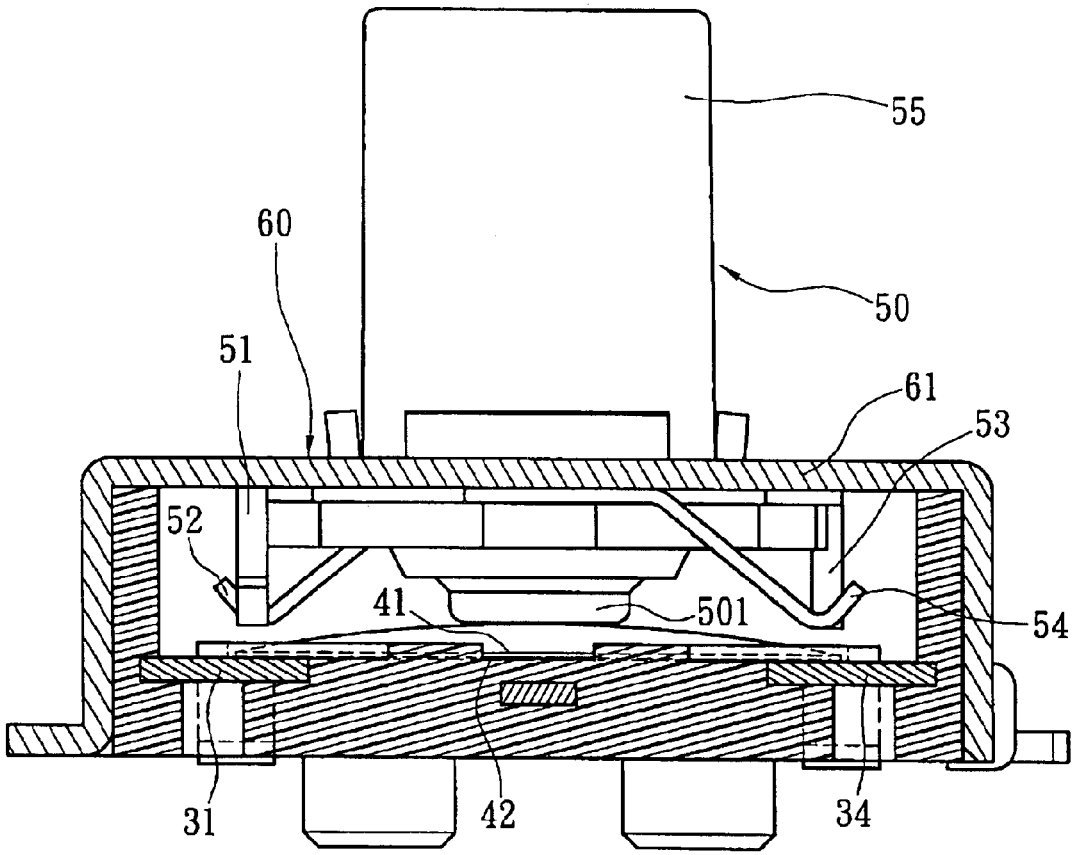
FIG. 4A is a cross section of taken on line 4A—4A in FIG. 3A showing the joystick not being depressed.
Figure 4B:
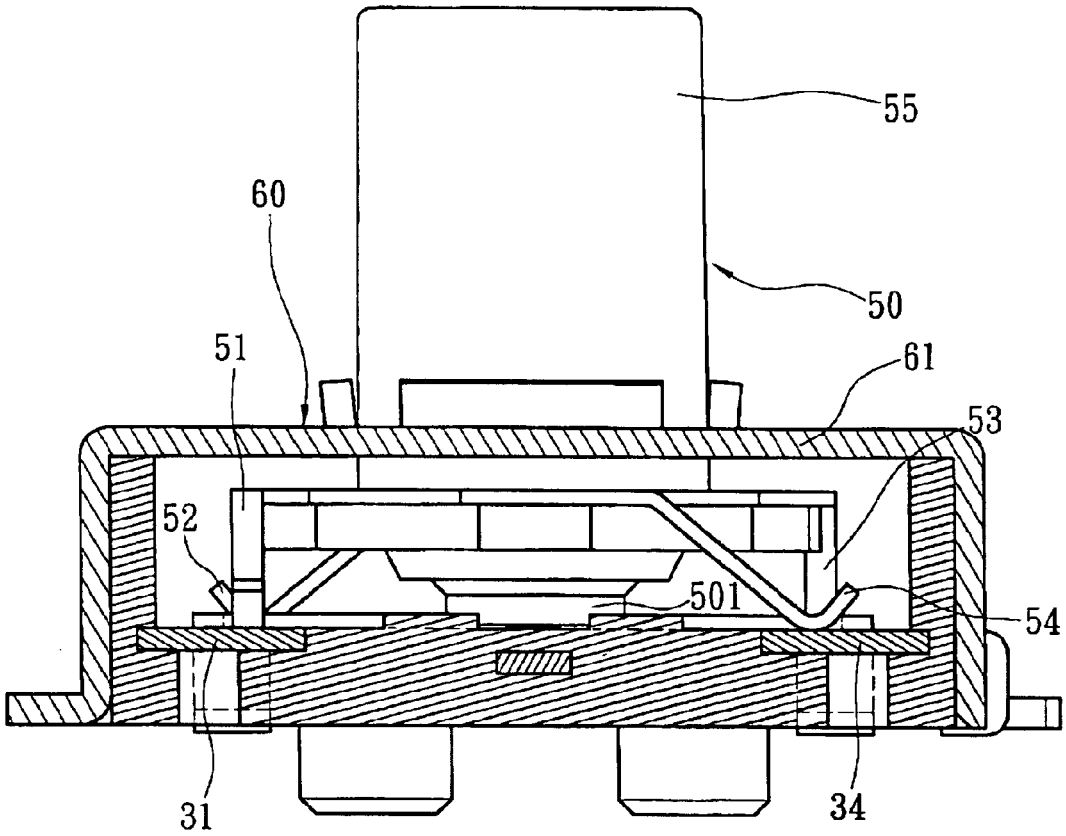
FIG. 4B is a schematic view of the multi-direction switch according to the invention in an operation condition showing the joystick depressed.

Please referring to FIG. 2A, the multi-direction switch according to the invention includes:

a base dock 20 which is substantially a box type element with a bottom and an opening directing upwards. It has a plurality of electrode elements located therein. Referring to FIG. 2B, the electrode elements include:

a first to a fourth direction electrodes 31–34 located on a bottom side 201 of the base dock 20. In a preferred embodiment, they are located at four corners of the bottom side 201. The four direction electrodes 31–34 are flat conductive elements (generally made of metal plate), and have respectively a leg 311, 321, 331 and 341 extending outside the base dock 20 to connect to a circuit (such as a circuit of a printed circuit board);

a compression electrode 35 located in the center of the base side 201. It also is a flat conductive element and has a leg 351 extending outside the base dock 20 to connect to the circuit (such as the circuit of the printed circuit board);

a common electrode 36 (generally a common ground electrode) located around the compressing electrode 35. It also is a flat conductive element and has a leg 361 extending outside the base dock 20 to connect to the circuit (such as the circuit of the printed circuit board);

a first conductive elastic blade 41 and a second conductive elastic blade 42 (referring to FIG. 2A) that are overlapped with each other and formed in a shape as a portion of a spherical surface. They have a center point P located above the compression electrode 35. The center point P and the compression electrode 35 are not in contact with each other in normal conditions (referring to FIG. 4A). The second conductive elastic blade 42 has a peripheral bottom sinking into a trough formed on the bottom side 201 above the common electrode 36 (referring to FIG. 3B). The elastic blade 42 is in contact with the common electrode 36 in normal conditions. The center point P of the second conductive elastic blade 42 may be in contact with the compression electrode 35 when subject to compression (referring to FIG. 4B). In that condition the compression electrode 35 is connected to the common electrode 36 through the second conductive elastic blade 42 that generates a corresponding compression instruction signal through the electronic device connecting to the leg 351;

a joystick 50 which has an operation stem 55 extending vertically upwards and first to fourth conductive legs 51–54 fixedly located around the operation stem 55. The first to fourth conductive legs 51–54 are connected to the common electrode 36 through a bottom end 501 (being conductive) of the joystick 50 that is in contact with the first conductive elastic blade 41 in normal conditions. The main feature is that first to fourth conductive legs 51–54 have distal ends extending respectively in a biased manner towards the first to fourth electrodes 31–34. However, in normal conditions, they are not in contact with the first to fourth electrodes 31–34 (as shown in FIG. 4A). When an user moves the operation stem 55 of the joystick 50 (referring to FIG. 3C), one or more of the first to fourth conductive legs 51–54 in the corresponding direction will be moved accordingly to connect to one or more of the first to fourth electrodes 31–34 corresponding to the moving direction of the joystick 50. Therefore, through the connection of the first to fourth conductive legs 51–54, and the first conductive elastic blade 41 that is in contact with the bottom end 501 of the joystick 50 in normal conditions, and the second conductive elastic blade 42, it is connected to the common electrode 36, and through detecting the signal triggering conditions of the first to fourth electrodes 31–34, the "directional instruction" input by the joystick 50 may be determined; and an upper cap 60 has a flat surface 61 and an opening 62 formed in the center of the flat surface 61 to allow the operation stem 55 of the joystick 50 to pass through. There are a plurality of latch lugs 63 formed on the periphery of the flat surface 61 each has an aperture 631 engageable with a reverse hook 21 extending from the periphery of the base dock 20. Therefore the upper cap 60 can encase the joystick 50, and the first and second conductive elastic blades 41 and 42 on the base dock 20 (referring to FIG. 3A).

As the first to fourth direction electrodes 31–34 are located at the four corners of the bottom side 201 of the base dock 20, whatever the downward displacement of the center point P of the first and second conductive elastic blades 41 and 42, the biased distal ends, either extended at a sloped angle or a gradient, of the first to fourth conductive legs 51–54 can be moved towards the first to fourth direction electrodes 31–34. Hence the interval problem between the distal ends of the first to fourth conductive legs 51–54 and the first to fourth direction electrodes 31–34 may be improved. As a result, erroneous movements from the joystick 50 that cause mistaken contact between the first to fourth conductive legs 51–54 and the first to fourth direction electrodes 31–34 may be avoided.

Due to the distal ends of the first to fourth conductive legs 51–54 are designed in a biased manner, the interval between them and the first to fourth direction electrodes 31–34 may reach 0.3 mm or more in normal conditions. Thus the oscillation amplitude of the joystick 50 may increase, and operation maneuverability improves, and fabrication and assembly difficulty may be reduced.

What is claimed is:

1. A multi-direction switch, comprising:

a base dock being substantially a box type element having a bottom side;

a plurality of direction electrodes located on the bottom side of the base dock extending respectively outside the base dock to form first legs;

a compression electrode located in the center of the base side extending outside the base dock to form a second-leg;

a common electrode located on the base side around the compressing electrode extending outside the base dock to form a third leg;

a first conductive elastic blade and a second conductive elastic blade formed respectively in a shape as a portion of a spherical surface overlapping with each other having a center point located above the common electrode; wherein the first conductive elastic blade and the second conductive elastic blade are not in contact with each other in normal conditions, the second conductive elastic blade having a peripheral bottom end located above the common electrode to be in contact with the common electrode in the normal conditions, the center point of the second conductive elastic blade being in contact with the compression electrode when subject to compression to establish conductive connection between the compression electrode and the common electrode;

a joystick having an operation stem extended vertically upwards and a first to a fourth conductive legs around the operation stem, the first to fourth conductive legs being connected to the common electrode through a bottom end of the joystick that is in contact with the first conductive elastic blade in normal conditions, the first to fourth conductive legs having distal ends extending respectively in a biased manner towards the first to the fourth direction electrodes, and not being in contact with the first to the fourth electrodes in the normal conditions, one or more of the conductive legs being in contact with one or more of the direction electrodes in a corresponding moving direction of the joystick when the joystick is moved; and an upper cap encased the base dock having an opening to allow the operation stem of the joystick to pass through.

2. The multi-direction switch of claim 1, wherein the direction electrodes are located at four corners of the bottom side.

3. The multi-direction switch of claim 1, wherein the direction electrodes, the compression electrode and the common electrode are flat conductive elements.

4. The multi-direction switch of claim 3, wherein the direction electrodes, the compression electrode and the common electrode are made of a metal plate.

5. The multi-direction switch of claim 1, wherein the upper cap has a flat surface, the opening being formed in the center of the flat surface which has a plurality of latch lugs formed on the periphery thereof, each of the lugs having an aperture engageable with a reverse hook formed on the periphery of the base dock.

* * * * *